United States Patent [19]

de Jong

[11] 4,456,157

[45] Jun. 26, 1984

[54] CONNECTION ARRANGEMENT FOR A SPOUT AND AN IMMERSION NOZZLE, BOTH OF REFRACTORY MATERIAL

[75] Inventor: Wybrand A. de Jong, Castricum, Netherlands

[73] Assignee: Estel Hoogovens BV, IJmuiden, Netherlands

[21] Appl. No.: 384,199

[22] Filed: Jun. 3, 1982

[30] Foreign Application Priority Data

Jun. 5, 1981 [NL] Netherlands ..... 8102725

[51] Int. Cl.³ ..... B22D 41/00

[52] U.S. Cl. ..... 222/591; 222/607

[58] Field of Search ..... 222/591, 592, 603, 606, 222/607, 629, 519, 520; 285/9 R; 164/337, 437

[56] References Cited

U.S. PATENT DOCUMENTS 3,502,134 3/1970 Orehoski ..... 222/591 X 4,091,861 5/1978 Thalmann et al. ..... 164/437

4,131,220 12/1978 Bode, Jr. et al. ..... 222/607

*Primary Examiner*—Joseph J. Rolla

*Assistant Examiner*—George S. Pyryt

[57] ABSTRACT

A nozzle of refractory material is demountably connected to a spout, also of refractory material, for flow of liquid metal from the spout into the nozzle. The spout is supported by a first metal support ring and the nozzle is carried by a second metal support ring which has projecting arms by which it is lifted to bring the nozzle into position. To provide a seal of the connection against access of atmospheric oxygen to the liquid metal, a sleeve is slidably and rotatably mounted on the second support ring. On rotation of the sleeve, cam means a cam action between the lower sleeve surface and the projecting arms effect its upward movement so that its top edge engages the first support ring to seal thereto. The sleeve leaves an annular gap between itself and the nozzle, to which inert gas is supplied.

6 Claims, 2 Drawing Figures

Figure 1:
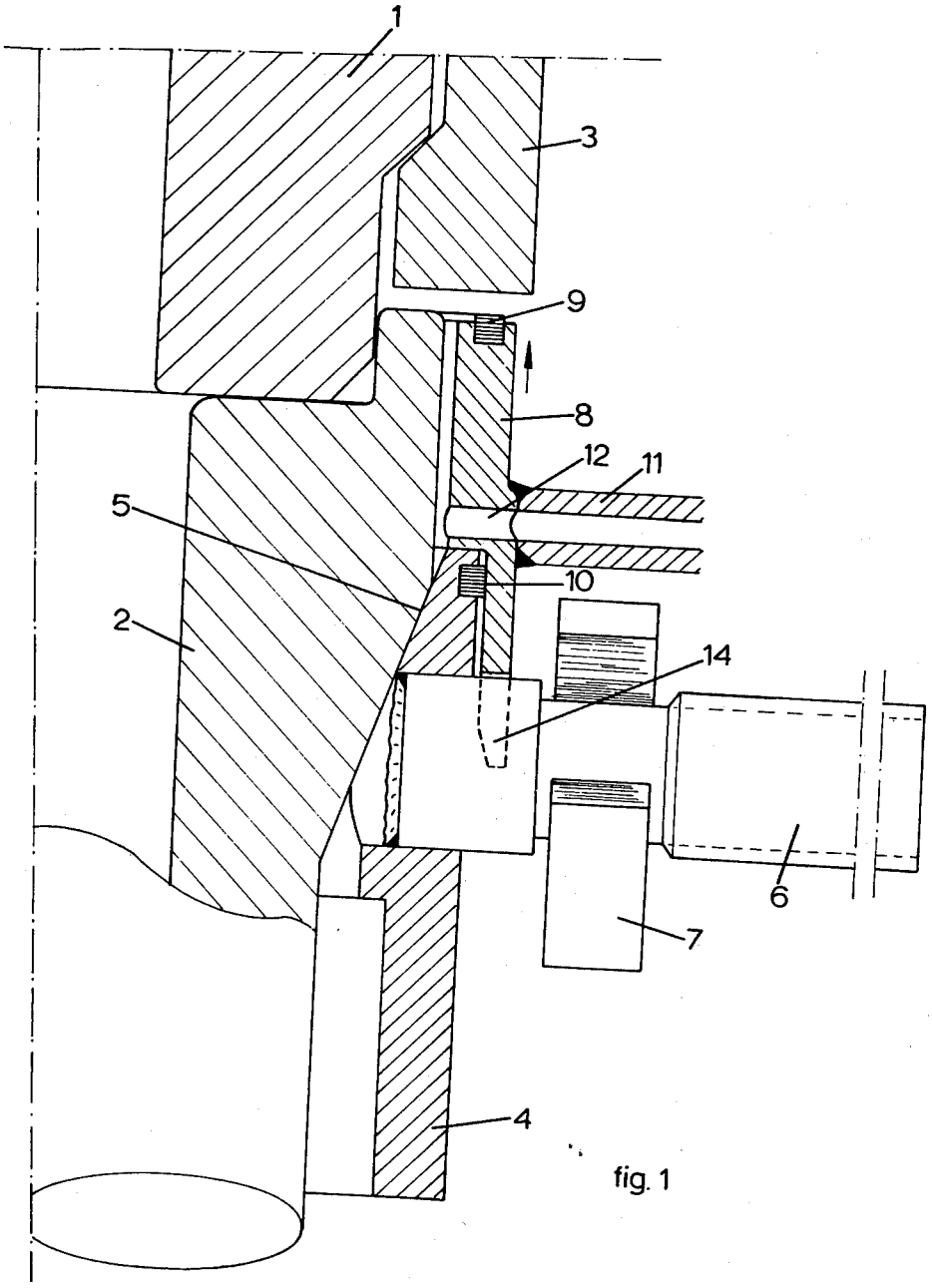

CONNECTION ARRANGEMENT FOR A SPOUT AND AN IMMERSION NOZZLE, BOTH OF REFRACTORY MATERIAL

BACKGROUND OF THE INVENTION

1. Field of the Invention

The invention relates to the connection arrangement of an immersion nozzle of refractory material and a spout, also of refractory material which are detachably connected for flow of liquid metal from the spout into the nozzle.

2. Description of the Prior Art

Immersion nozzles are generally used in the casting of molten steel or other liquid metals in cases where the casting stream must be shielded from the oxygen of the surrounding air. An example of this is the casting of steel from a ladle into the mould of a casting machine, but there are many other applications of immersion nozzles for similar purposes.

In a known arrangement, the nozzle is carried by a metal support ring which has projecting arms or spigots by which it is lifted to bring the nozzle into position relative to the spout. The spout is also supported by a metal ring.

Since immersion nozzles are subject to wear, it is important that they can be mounted simply and fast. However, it has been found that problems can arise in practice. Particularly, at the connection of the immersion nozzle to the spout, where both parts are made from a refractory material, there is a joint which is not completely air-tight. As a result of the high temperature of the spout and the nozzle during the casting of, for instance, steel, a completely air-tight joint is difficult to obtain. The under-pressure which prevails in the immersion nozzle during the casting thus leads to air being drawn in at the connection, which not only leads to the combustion of steel and alloying elements in the casting stream, with all the undesired metallurgical consequences thereof, but also to a local degradation of the refractory material. This degradation can finally lead to failure of the immersion nozzle.

SUMMARY OF THE INVENTION

The invention has as its object to remedy these difficulties, and in particular to provide protection against access of outside oxygen to the liquid metal.

According to the invention, a sleeve is slidably and rotatably mounted on the support ring of the nozzle. Cam means cause upward movement of the sleeve, when it is rotated, so that its upper end engages the lower face of the support ring of the spout, thereby providing an exterior seal of the connection of the spout and the nozzle. The sleeve leaves an annular slot between itself and the nozzle, and connection means are provided for the supply of protective inert gas into this slot. Since protective gas is supplied, the sealing effected by the sleeve need not be fully gas-tight.

Preferably the cam means which effects movement of the sleeve is one or more cam surfaces on the lower edge of the sleeve, which surfaces engage one or more of the projecting arms of the support ring of the nozzle.

It is noted that the prevention of leakage at the points of contact between refractory elements by means of the local supply of a shielding gas is in itself a well-known technology. However, hitherto no construction has been known which could achieve this in a very simple, cheap and compact manner for the connection of an exchangeable immersion nozzle to a spout.

Since the sleeve is moveable over the support ring of the nozzle, and since it is moved up to engage the support ring of the spout, the annular slot between the immersion nozzle and the sleeve is bounded by the connections between the sleeve and the support ring of the spout, and between the sleeve and the support ring of the nozzle respectively. In order to limit the consumption of shielding gas (which is for instance, argon) it may be desirable to fit heat-resistant packing rings between the sleeve and the support ring of the nozzle and at the location of the contact between the sleeve and the sealing end surface of the support ring of the spout. The quality of these packing rings is then what determines the consumption of shielding gas. However, it should be noted that by using less shielding gas, its cooling effect will be reduced, so that in practice a compromise has to be sought between gas consumption and cooling.

It appears that by using the arrangement of the invention, it is possible to eliminate entirely the leakage of atmospheric oxygen at the connection between the immersion nozzle and the spout. This leads to a significant improvement of the quality of the cast steel and to a substantial saving in nozzles. Another advantage obtainable is a local cooling of the support ring of the nozzle, so that this is less prone to deformation. This in its turn leads to a better fit between nozzle and its support ring, which is advantageous for the mechanical loading of the immersion nozzle and hence for its lifetime.

A good seal, in combination with good sliding properties between the sleeve and the support ring of the nozzle can be obtained if heat-resistant packing rings, e.g. of graphite, are fitted, preferably one ring being recessed into the face of the support ring opposed to the sleeve and another recessed into the upper edge of the sleeve.

In order to move the sleeve upwards to the sealing end-surface of the spout support ring, the sleeve has to be rotated. For this purpose it can be provided with special handles. A constructionally simple solution is obtained if the connecting element for the supply of inert protective gas is shaped and located to serve as a handle for rotating the sleeve.

BRIEF INTRODUCTION OF THE DRAWINGS

Figure 2:
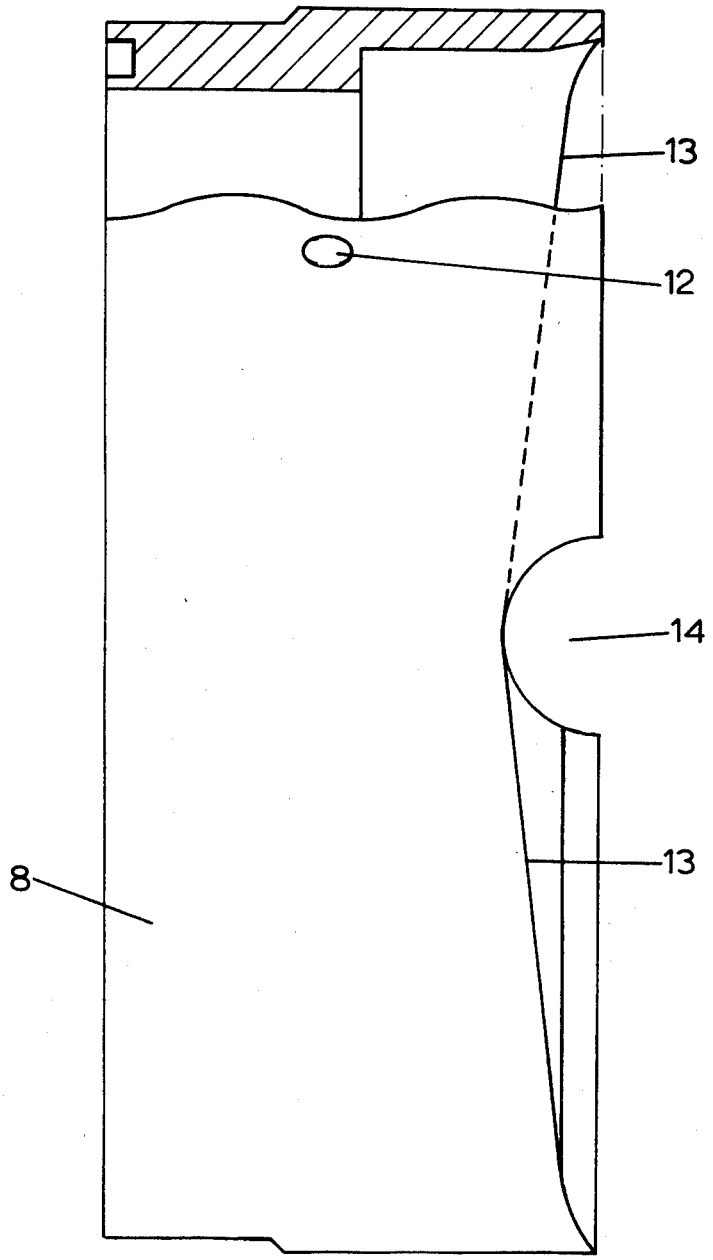

The preferred embodiment of the invention will now be described by way of non-limitative example and with reference to the accompanying drawings, in which:

FIG. 1 shows the connection between a spout and a nozzle in an arrangement according to the invention in longitudinal section, and FIG. 2 shows the sleeve of the connection of FIG. 1 partly in elevation and partly in longitudinal section.

FIG. 1 shows a hollow spout 1 of refractory material to which there is demountably connected an immersion nozzle 2 also of refractory material for flow of liquid metal direct from the bore of the spout into the bore of the nozzle. The spout 1 is held in place by a metal support ring 3, which is shown schematically. This ring 3 has a flat sealing end-surface facing downwardly. The immersion nozzle 2 hangs by an enlarged top portion in a support ring 4, both the nozzle 2 and the support ring 4 having conical surfaces 5. The shape of the support ring 4, which extends downwards, is so chosen that it is sufficiently rigid and that its large surface can serve to remove heat from the nozzle into the surroundings.

On opposite sides of the support ring 4, two lifting arms or spigots 6 project outwardly. These are used to lift the supporting ring up until the immersion nozzle 2 makes contact with the spout 1. The lifting of the support ring 4 can be carried out by any device suitable for this purpose. The figure shows schematically hooks 7 which engage the lifting spigots 6.

A sleeve 8 is slidably received over the uppermost outer cylindrical surface part of the support ring 4. This sleeve leaves free an annular slot between itself and the enlarged top part of the immersion nozzle 2. A gasket ring 9 made of heat-resistant graphite is fitted to a recess in the upper edge of the sleeve 8, and a similar packing ring 10 is fitted in a recess in the cylindrical surface of the support ring 4 facing the sleeve 8. When the sleeve 8 is moved upwardly in the direction of the arrow the ring 9 engages the flat lower face of the ring 3 and a fair degree of sealing between the sleeve and the supporting ring is achieved. The annular slot between the sleeve 8 and the immersion nozzle 2 is thus sealed off from the surrounding air. This space is connected with a source of argon under over-pressure by means of a connector 11 on the sleeve, so that the entry of atmospheric oxygen into any gap between the immersion nozzle 2 and the spout 1 is completely avoided. In addition the argon introduced has a cooling effect on the sleeve 8.

The raising of sleeve 8 in the direction of the arrow is accomplished by rotating the sleeve, using the connector 11 as a handle, about the axis of the sleeve, so that a guiding or cam surface 13 at the lower edge of the sleeve 8 (see FIG. 2) runs over the spigot 6, and thus effects raising of the sleeve through a cam action. Although the connector 11 is drawn in FIG. 1 in the same plane as the bearing journals 6, in practice the connector 11 is so located on the sleeve that when the whole sleeve is rotated, it remains outside the axial plane through the bearing journals.

To give more detail of the cam faces, FIG. 2 shows the sleeve 8 partly in elevation and partly in section. It can be seen from this that the lower edge of the sleeve is provided with two cam or guiding surfaces 13 which terminate in a semicircular recess 14. The guiding surfaces 13 each extend over 90° of the circumference of the sleeve. A bore 12, at the point where connector 11 (not shown) is welded on, is located at a place on the circumference of the sleeve beyond the extent of the guiding surfaces 13.

What is claimed is:

1. In an arrangement for the demountable connection of an immersion nozzle of refractory material and a spout also of refractory material so that liquid metal can flow from the spout into the nozzle, the spout being supported by a first metal support ring having a downwardly facing lower surface and the nozzle being carried by a second metal support ring having projecting arms by which second support ring is lifted in order to bring the nozzle into its mounted position relative to the spout, the improvement that in order to provide protection against access of atmospheric oxygen to the liquid metal, a metal sleeve is slidaly mounted on the second support ring while making sealing contact therewith so as to be upwardly movable in its axial direction to seal against said lower surface of the first support ring, the sleeve leaving an annular slot between itself and the nozzle, there being a connection for supply of inert gas to said slot, and the sleeve being rotatable relative to the second support ring, which rotation causes, through cam means mounted on the second support ring and the metal sleeve, said upward movement of the sleeve.

2. Arrangement according to claim 1 wherein said sleeve has at least one cam surface on its lower axial end, which, with a surface of at least one of said projecting arms, forms said cam means effective to cause upward movement of the sleeve.

3. Arrangement according to claim 1 wherein heat-resistant sealing rings are provided to seal between said sleeve and the second support ring and between said sleeve and the lower surface of the first support ring.

4. Arrangement according to any one of claims 1 to 3 wherein a connection element for supply of said inert gas is provided on said sleeve and is shaped so as to form a handle for the rotation of the sleeve.

5. Arrangement according to claim 3 wherein said sealing rings are graphite rings mounted respectively in an exterior surface of said second support ring and in the upper end surface of said sleeve.

6. A nozzle assembly for liquid metal comprising a spout having a downwardly opening discharge mouth, formed of refractory material, an immersion nozzle of refractory material detachably mounted to said spout for flow of liquid metal from said mouth of said spout into the nozzle, a first metal support ring surrounding and supporting the spout and having a downward facing end surface, a second metal support ring surrounding and carrying the nozzle and having laterally projecting arms which, in use, are lifted to bring the nozzle into its mounted position a sealing sleeve having an axis mounted on the said second support ring so as to be movable upwardly and downwardly thereon in its axial direction while making sealing contact therewith, and having an upper end which, on upward movement of the sleeve engages the said downward facing end surface of the first metal support ring to form a seal therewith, the sleeve thereby sealing the connection of the spout and the nozzle from the outside atmosphere, there being an annular gap between the sleeve and the nozzle, and the sleeve also being rotatable about its axis on the second support ring with connection means for the supply of an inert gas into said annular gap, and cam means carried by said sleeve operative to effect axial movement of the sleeve on its rotation about its axis.

* * * * *